US005734169A

United States Patent [19]

Saidian

[11] Patent Number: 5,734,169

[45] Date of Patent: Mar. 31, 1998

[54] RADIOACTIVE WASTE STORAGE AND DISPOSAL RECEPTACLE

[76] Inventor: David Saidian, 7610 Foster, Wichita, Kans. 67206

[21] Appl. No.: 627,473

[22] Filed: Apr. 4, 1996

[51] Int. Cl.[6] ..... G21F 3/02

[52] U.S. Cl. ..... 250/506.1; 250/507.1

[58] Field of Search ..... 250/506.1, 507.1; 312/249.8

[56] References Cited

U.S. PATENT DOCUMENTS

| | | | |
|---|---|---|---|
| 4,357,541 | 11/1982 | Ernst | 250/507.1 |
| 4,907,717 | 3/1990 | Kubofcik | 250/506.1 |
| 4,913,309 | 4/1990 | Fink | 220/404 |
| 5,076,650 | 12/1991 | Klein et al. | 312/249.8 |
| 5,117,997 | 6/1992 | Fink | 20/23.86 |
| 5,225,114 | 7/1993 | Anderson et al. | 250/506.1 |

*Primary Examiner*—Bruce Anderson
*Attorney, Agent, or Firm*—Kenneth H. Jack

[57] ABSTRACT

A radioactive waste storage and disposal receptacle comprising a lead-lined bin defining an interior space for receiving and storing radioactive waste, a lead-lined lid pivotally attached to the lead-lined bin for closing and opening the interior space, the lead-lined lid having a waste insertion aperture therethrough, and a lead plug closely fitted for slidable movement into and out of the waste insertion causing such aperture to be alternately opened for insertion of waste therethrough and closed.

6 Claims, 3 Drawing Sheets

RADIOACTIVE WASTE STORAGE AND DISPOSAL RECEPTACLE

FIELD OF THE INVENTION

The invention relates to a storage and disposal receptacle having a hinged lid, the receptacle being adapted for receiving and storing medical waste materials which have been contaminated by radioactive isotopes. The walls, floor and lid of the receptacle are lead-lined, the lid having an aperture through which radioactive waste materials may be inserted, and the aperture having a lead shielded plug.

BACKGROUND OF THE INVENTION

Hospital and medical clinic X-ray and radiology departments commonly perform diagnostic procedures wherein fluids containing radioactive isotopes are injected into a patient intravenously or are introduced into a patient's gastrointestinal tract. Such procedures involve utilization of disposable syringes, needles, flexible tubing, plastic fluid bags, flasks and similar articles. Such articles are commonly disposed of after a single use. After such disposable materials are used, a residue of radioactive isotope containing fluid typically remains thereon. Such radioactive isotopes continuously emit alpha-particles, beta-particles and/or gamma and X-ray radiation. Cumulative exposure to such radiation over time is destructive of human tissue and hazardous to human life. Workers in hospital radiology departments have need of protective methods and apparatus which reduce such cumulative exposure to radiation.

Radioactive isotope contamination of disposable medical materials precludes disposal by conventional means. Standard waste receptacles do not shield from harmful radiation emitted from within. Thus, hospital radiology departments have a need of a protective means of disposing of radioactive isotope contaminated waste materials.

Radioactive isotopes used in medical diagnostic procedures have known radioactive half-lives. A half-life is the time required for an isotope to lose half of its radioactive strength or to disintegrate or decay by half. By storing materials contaminated by radioactive isotopes a sufficient length of time, a sufficient number of half-life periods may pass; allowing the material to thereafter be safely disposed of by conventional methods. The present invention provides an improved receptacle for receiving and storing radioactive isotope contaminated disposable materials during radioactive decay.

Radioactive waste receptacles used in radiology departments commonly take the form of a lead-lined box or bin having a hinged lead-lined lid. Typically, such lead-lined receptacles have an interior space large enough to accommodate several smaller bins. In use at any given time only one of such smaller bins within the larger lead-lined receptacle actively receives radioactive waste materials. Other bins within the lead-lined receptacle contain and store radioactive waste materials, awaiting passage of a sufficient number of half-lifes for safe conventional disposal.

The presence of smaller storage bins within the larger lead-lined receptacle requires that the receptacle have a lid large enough to allow the introduction and removal of the smaller bins, and to allow a technician to move the bins into various positions within the receptacle. While the lead-lined lid of the receptacle is opened and closed for such purposes, the technician is exposed to alpha, beta and gamma rays emitted from the radioactive waste materials. In common practice, such radiation exposure occurs each time the receptacle lid is opened for insertion of waste materials, and each time the lid is opened for repositioning of bins located within the receptacle. The majority of such radiation exposure events occurs when the receptacle lid is opened for insertion of waste materials. Such receptacle lids are opened less frequently for purposes of insertion, removal, and repositioning of smaller storage bins. An improvement of the present invention eliminates a majority of such radiation exposure events by eliminating the need for opening the receptacle lid for insertion of waste materials.

Such reduction in radiation exposure is accomplished by means of an aperture located within and through the lead-lined lid of a lead-lined radioactive waste storage receptacle, and a lead plug closely fitted to and capable of closing the aperture. The aperture is positioned within the lid so that when the lid is closed, the aperture overlies a smaller storage bin within the receptacle. Such smaller bin serves the purpose of actively receiving radioactive waste materials. The aperture preferably is small to reduce the amount of radiation which emits therethrough; however, the aperture must be large enough to receive common medical waste items.

In practice, a radioactive isotope contaminated article such as a plastic syringe may be disposed of by removing the lead plug to open the aperture, then inserting the syringe through the aperture, and then replacing the lead plug to close the aperture. Upon insertion through the aperture, the syringe falls into the smaller storage bin underlying the aperture. Utilization of this means of insertion of waste materials into the receptacle exposes the technician to a radiation level significantly less than the exposure which otherwise would occur upon opening of the receptacle lid. The improvement of the aperture and lead plug within the lid eliminates the need for repeatedly opening and closing the receptacle lid for insertion of radioactive waste materials. Where such an aperture and plug is present, the receptacle only needs to be opened when insertion, removal, or repositioning of the bins located therein is needed. Thus, utilization of a lead-plugged aperture for insertion of radioactive contaminated waste eliminates a majority of radiation exposure events relating to utilization of lead-lined radioactive waste storage and disposal receptacles.

BRIEF DESCRIPTION OF THE INVENTION

It is a principal object of this invention to design a lead-lined radioisotope contaminated waste storage and disposal receptacle having a lead plugged aperture means of insertion of radioactive waste through the lid thereof, which means reduces the level of exposure of the technician to radiation emitted from the receptacle.

It is a related object of this invention to design the above receptacle so that it may contain a plurality of smaller storage bins within the receptacle, allowing a single active bin to underlie the waste insertion aperture while other bins containing radioactive waste within the receptacle are stored, awaiting radioactive decay to be followed by conventional disposal.

It is a further object of the present invention to provide a lead-lined radioactive waste storage and disposal receptacle having interior and exterior laminations of sheet material encasing a shielding lamination of lead, the interior and exterior laminations providing for structural durability.

It is a further object of the present invention to provide a lead-lined radioactive waste storage receptacle having casters mounted upon its lower surface for portability of the receptacle.

It is a further object of the present invention to provide a handle fixedly attached to the lid of the receptacle for ease of opening and closing the lid.

It is a further object of the invention to provide a finger pull ring fixedly attached to the upper surface of the lead plug for ease of removal of the plug from and insertion into the aperture.

Other and further objects, advantages and features of the present invention will be understood by reference to the following specification in conjunction with the annexed drawings.

DETAILED DESCRIPTION OF THE PREFERRED EMBODIMENT

The present invention is directed to a lidded radioactive isotope contaminated waste storage and disposal receptacle having an aperture through the lid thereof for the insertion of such waste, and having a lead plug closely fitted to said aperture for closing said aperture.

Figure 1:
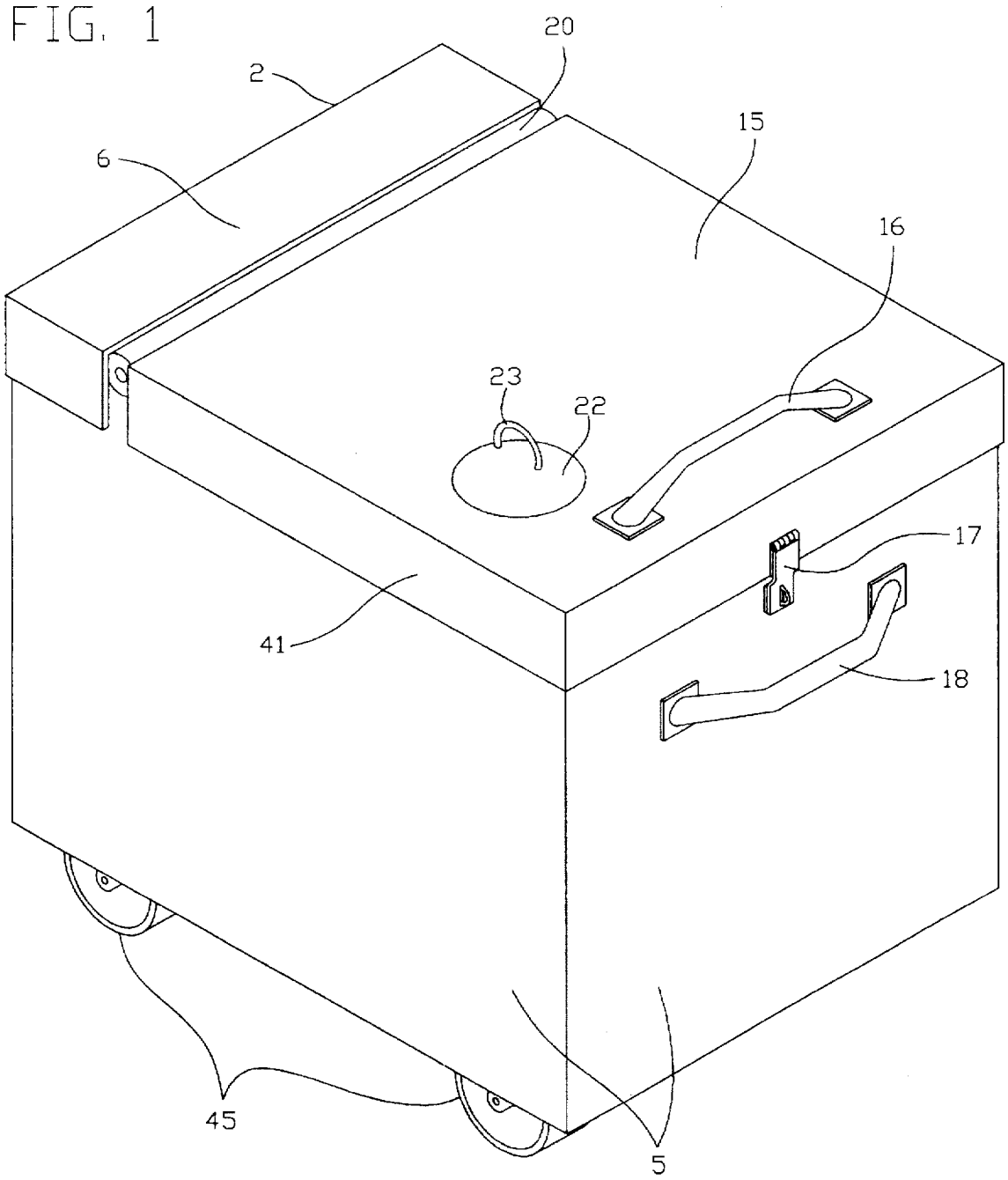
FIG. 1 is a perspective view of the lead-lined radioactive waste storage and disposal receptacle.
Figure 2:
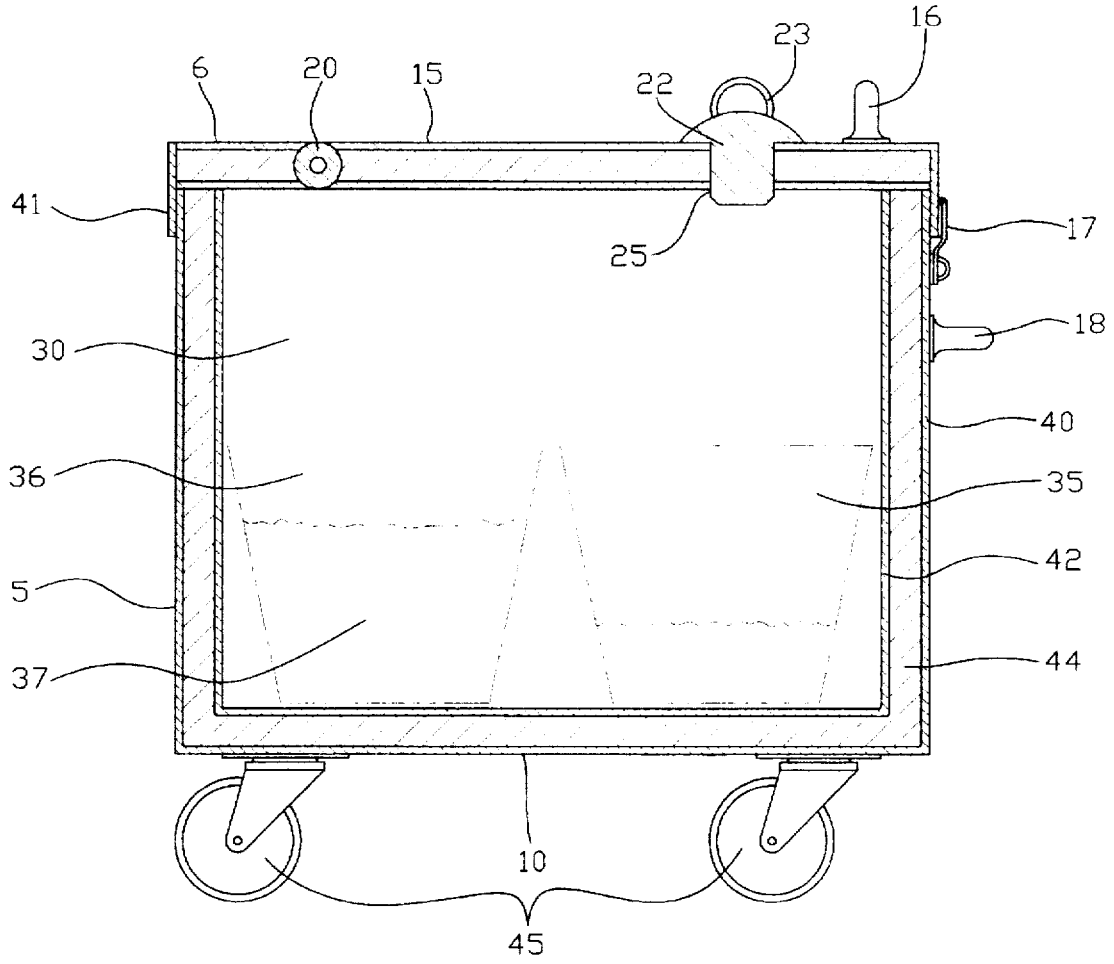
FIG. 2 is a side cutaway view of the lead-lined receptacle; the plane of the cutaway section passing through the lead plug and aperture.

Referring to FIG. 1, the lead-lined receptacle 2 is configured as a rectangular box having four vertical walls 5, each vertical wall 5 being fixedly attached to the walls adjacent to it at the corners of the rectangle. Referring to FIG. 2, the receptacle has a rectangular floor 10 the edges of which are fixedly attached to the lower edges of the vertical walls 5. Referring to FIG. 1, the receptacle has a rectangular hingeplate 6 fixedly attached to the upper surface of the vertical walls 5 at the rear of the receptacle. The receptacle further has a rectangular lid 15 closely fitted to overlie and cover the portion of the opening of the receptacle 2 which is not covered by the hingeplate 6; the rear edge of the rectangular lid 15 being pivotally attached to the front edge of the hingeplate 6 by means of a hinge 20.

Referring to FIG. 2, the rectangular lid 15 has a circular aperture 25 therethrough which is closed by a closely fitted cylindrical flanged plug 22. The flanged plug 22 has a finger pull ring 23 fixedly attached to its upper surface allowing the flanged plug 22 to be alternately manually removed from and inserted into the circular aperture 25. The interior space 30 of the receptacle is large enough to store a plurality of small storage bins 35 and 36 for receiving and storing radioactive isotope contaminated medical waste 37. The circular aperture 25 and flanged plug 22 are positioned within the rectangular lid 15 so that waste materials may be dropped downward through the circular aperture 25 and into a storage bin 35 positioned below the aperture. Storage bins 37 positioned elsewhere within the interior space 30 are held therein for purposes of shielded storage while awaiting radioactive decay, followed by conventional disposal.

The flanged plug 22 is preferably composed of lead providing shielding from radiation which would otherwise emit through the aperture 25. The finger pull ring 23 is preferably composed of steel, the lower portion of which is embedded within the lead of the plug 22.

Figure 3:
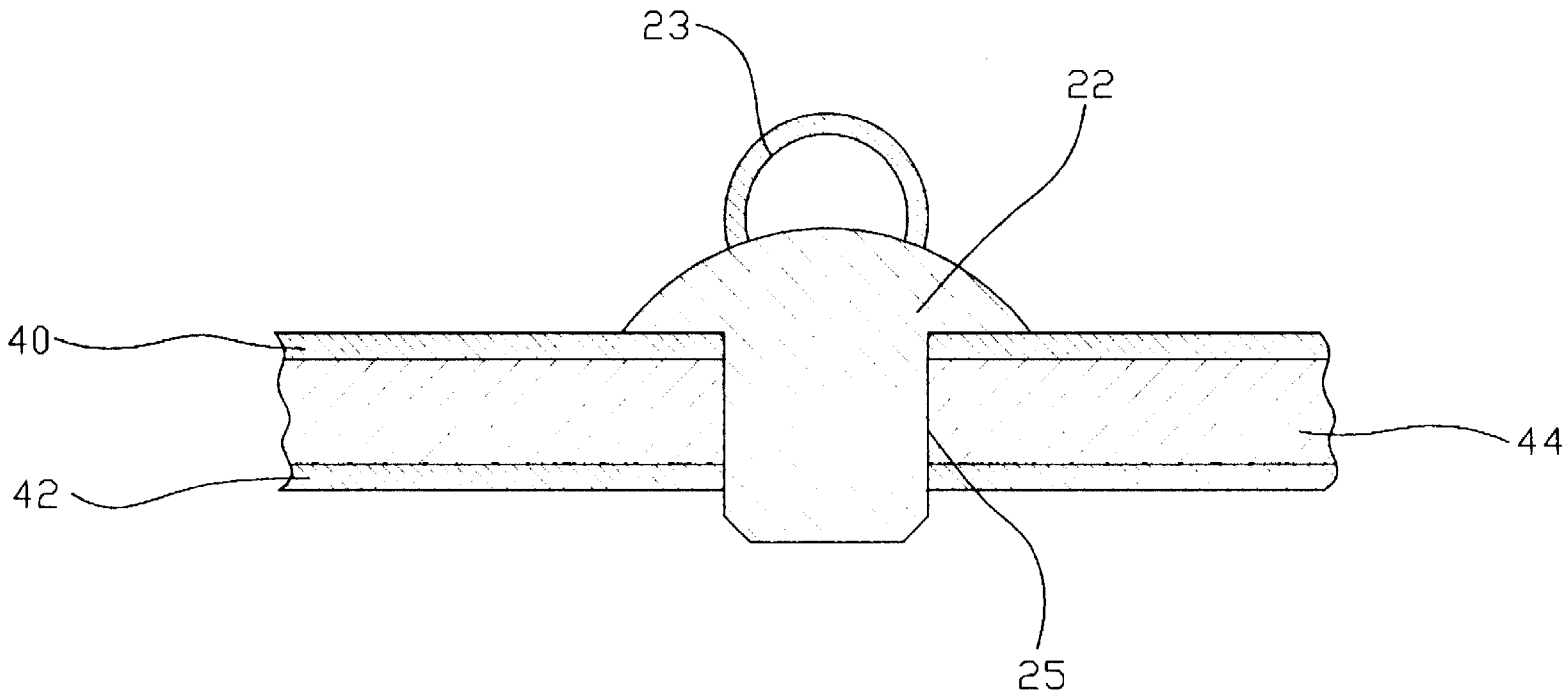
FIG. 3 is a detail cutaway view of the lid of the receptacle exemplifying the laminated composition of the lid, walls, and floor of the receptacle.

Referring to FIG. 2 and FIG. 3, the exterior surfaces of the vertical walls 5, floor 10, rectangular lid 15, and hingeplate 6 are lined with a sheet material 40 composed of steel, aluminum alloy, plastic, or plywood. On the outer periphery of the rectangular lid 15 and the hingeplate 6, the sheet material 40 forms a downward protruding flange 41 covering the seam between the lid 15 and the vertical walls 5. The interior surfaces of the floor 10, the vertical walls 5, the hingeplate 6, and the rectangular lid 15 are also lined with a similarly composed sheet material 42. Disposed between the exterior and interior sheet material linings 40 and 42 is a layer of lead 44, preferably three-quarters of an inch in thickness for providing shielding of radiation.

Referring to FIG. 1, the rectangular lid 15 has a lid handle 16 fixedly attached thereto and a latch 17. In operation, a radiologist or radiology clinic worker opens the latch 17 and pulls upward on the lid handle 16 causing the rectangular lid 15 to move pivotally upward about the hinge 20, and, referring to FIG. 2, opening the interior space 30. The radiologist then places a storage bin 35 within the interior space 30 and upon the floor 10, the bin being positioned to underlie the circular aperture 25 when the rectangular lid 15 is closed. Upon such placement of a storage bin 35 within the interior space 30, the rectangular lid 15 is closed and the latch 17 is closed. In operation, a padlock may be used to secure the latch 17. With a storage bin 35 so situated within the interior space 30, the receptacle 2 is ready for receiving radioactive isotope contaminated medical waste.

In order to introduce radioactive isotope contaminated medical waste into the storage bin 35, a radiologist grasps and pulls upward on the pull ring 23 causing the cylindrical flanged to plug 22 to move upward out of the circular aperture 25. Waste items such as a radioactive isotope contaminated syringe may then be dropped through the circular aperture 25 to fall into the storage bin 35. The radiologist may look through the circular aperture 25 and into the storage bin 35 by means of a pen light and mirror to avoid exposure of the radiologist's eye to radiation emitting out of the circular aperture 25.

When a storage bin 35 is filled, the rectangular lid 15 must be re-raised and the filled storage bin 35 is then repositioned elsewhere on the floor 10 within the interior space 30. When this operation is performed a new empty storage bin may be replaced within the interior space 30 and positioned to underlie the circular aperture 25. The storage bin removed from under the circular aperture 25 may be dated in order to record the length of storage or number of radioactive half-lifes which have passed. While such manipulations of bins within the interior space 30 takes place, the radiologist is exposed to alpha, beta and gamma radiation emitted by the radioactive isotope contaminated medical waste. In order to protect from the hazards of such radiation, the radiologist may wear a protective lead-lined apron while performing such operations.

Storage bins containing radioactive isotope contaminated medical waste stored within the interior space 30 of the receptacle 2 are removed from the receptacle 2 by following a process similar to that outlined above. Times for removal of bins containing radioactive isotope contaminated medical waste are determined by the lengths of the half-lives of the particular isotopes contained within the storage bins. Storage bins containing radioactive isotope contaminated medical waste are removed only after radioactive decay has progressed to a point that radiation emitted from the waste is no longer a hazard.

The presence of lead shielding 44 within the floor 10, vertical walls 5, hingeplate 6, and rectangular lid 15 causes the receptacle 2 to be extremely heavy. In order to facilitate movement of the receptacle 2, four casters 45 are rotatably and pivotally mounted on the lower surface of the floor 10 of the receptacle 2. With casters 45 so mounted the receptacle 2 may be moved by pushing or pulling upon a receptacle handle 18 which is fixedly attached to the front vertical wall 5.

While I have shown and described a particular preferred embodiment of my invention, it is to be understood that the same is susceptible to numerous changes to one skilled in the art, therefore, I do not wish to be limited to the details shown and described, but intend to show all changes and modifications which come within the scope of the appended claims.

What I claim is:

1. A radioactive waste storage and disposal receptacle, comprising:

(A) A lead lined bin having a floor and having a plurality of side walls fixedly attached to and rising upward from the floor, the floor and the side walls forming and defining an interior space for receiving and storing radioactive waste materials;

(B) A lead lined lid capable of overlying and covering the interior space of the lead lined bin thereby forming a lead lined closed chamber for shielding persons and objects outside the chamber from radiation emitted from radioactive waste materials stored within the chamber; the lid having a waste insertion aperture therethrough, the aperture being capable of receiving radioactive waste materials dropped therethrough into the closed chamber; and, (C) A lead plug, the plug being closely fitted for insertion into the waste insertion aperture of the lead lined lid, the lead plug being alternately movable slidably out of the waste insertion aperture, allowing radioactive waste materials to be dropped through the aperture into the lead lined closed chamber, and being movable slidably into the waste insertion aperture, closing the aperture, the lead plug being shaped and sized so that upon such closure of the aperture, the lead of the plug provides continuity of the lead lining of the lid across the aperture.

2. The receptacle of claim No. 1 wherein the lead-lined bin is fitted for receiving and storing a plurality of non-lead lined storage bins for receiving newly discarded radioactive waste materials and for segregated storage of radioactive waste materials awaiting radioactive decay; wherein the waste insertion aperture is positioned within the lead-lined lid so that while the lid is in a closed position, the aperture may overlie a storage bin stored within the interior space of the lead-lined bin; and, further comprising, a plurality of hinges the leaves of which are fixedly and pivotally attached to the lead-lined bin and to the lead-lined lid, the hinges being positioned to allow the lead-lined lid to pivot about the hinge from a first position wherein the interior space of the lead-lined bin is closed, to a second position wherein the interior space of the lead-lined bin is open.

3. The receptacle of claim No. 2 wherein the upper end of the lead plug has a flange therearound, the flange being capable of engaging with the upper surface of the lead-lined lid at the periphery of the waste insertion aperture and being capable of preventing the plug from passing completely through the aperture upon insertion into the aperture.

4. The receptacle of claim No. 3 further comprising a handle fixedly attached to the upper surface of the lead-lined lid for opening and closing the lid; a finger pull ring fixedly attached to the upper surface of the lead plug for removing the lead plug from and inserting the lead plug into the waste insertion aperture; a locking and unlocking means fixedly attached to and inter-connecting the lead-lined lid and the lead-lined bin; and further comprising a plurality of wheels rotatably mounted upon the lower surface of the floor of the lead-lined bin.

5. The receptacle of claim No. 1 wherein the interior surfaces of the lead-lined lid and the lead-lined bin are lined with a sheet material, which material consists of steel, an aluminum alloy, plastic, or plywood; wherein the exterior surfaces of the lead-lined lid and the lead-lined bin are lined with a sheet material consisting of steel, an aluminum alloy, plastic, or plywood; and wherein the lead lining is disposed between the interior and the exterior sheet material linings of the lead-lined lid and the lead-lined bin.

6. The receptacle of claim No. 5 wherein the exterior sheet material lining of the outer periphery of the lead-lined lid forms a flange which, when the lead-lined lid is closed, extends vertically downward, partially overlapping the exterior surfaces of the lead-lined bin and covering the seam between the lead-lined lid and the lead-lined bin.

* * * * *